US010464221B2

(12) United States Patent
Ikoma

(10) Patent No.: US 10,464,221 B2
(45) Date of Patent: Nov. 5, 2019

(54) FOLDING KNIFE WITH LOCKING MECHANISM

(71) Applicant: GB II Corporation, Tualatin, OR (US)

(72) Inventor: Flavio Yuji Ikoma, Sao Paulo (BR)

(73) Assignee: GB II Corporation, Tualatin, OR (US)

( * ) Notice: Subject to any disclaimer, the term of this patent is extended or adjusted under 35 U.S.C. 154(b) by 2 days.

(21) Appl. No.: 15/787,514

(22) Filed: Oct. 18, 2017

(65) Prior Publication Data

US 2018/0036893 A1 Feb. 8, 2018

Related U.S. Application Data

(63) Continuation of application No. 14/855,179, filed on Sep. 15, 2015, now Pat. No. 9,833,912.

(60) Provisional application No. 62/050,648, filed on Sep. 15, 2014.

(51) Int. Cl.
*B26B 1/04* (2006.01)

(52) U.S. Cl.
CPC ..... *B26B 1/042* (2013.01); *B26B 1/046* (2013.01)

(58) Field of Classification Search
CPC ..... B26B 1/042; B26B 1/046
USPC ..... 30/160, 161
See application file for complete search history.

(56) References Cited

U.S. PATENT DOCUMENTS 4,170,061 A 10/1979 Henry
4,190,953 A * 3/1980 Naifeh ..... B26B 1/02 30/155
4,551,917 A 11/1985 Walker
4,750,267 A 6/1988 Boyd
5,093,995 A * 3/1992 Jan ..... B26B 1/046 30/155
5,111,581 A 5/1992 Collins
5,293,690 A 3/1994 Cassady
5,755,035 A * 5/1998 Weatherly ..... B26B 1/044 30/160
5,915,792 A 6/1999 Sakurai
(Continued)

FOREIGN PATENT DOCUMENTS

CN 102756384 A 10/2012

OTHER PUBLICATIONS

First Office Action (with English Translation) and Search Report from the State Intellectual Property Office of the People's Republic of China for Chinese Patent Application No. CN2015105874393, dated Apr. 16, 2018, 15 pages.
(Continued)

*Primary Examiner* — Hwei-Siu C Payer
(74) *Attorney, Agent, or Firm* — Klarquist Sparkman, LLP

(57) ABSTRACT

Folding knife embodiments are disclosed herein comprising a blade operable to pivot relative to a handle, between an open position and a closed position, about a pivot axis extending through a tang portion of the blade having at least one locking recess. The knife can have a locking mechanism comprising a rod that extends along the pivot axis through the tang portion and a locking member coupled to the rod which engages the at least one locking recess of the tang portion when the blade is in at least one of the open position or the closed position. The knife can further comprise a push button coupled to the rod, wherein depression of the push button is configured to eject the locking member from the locking recess in the blade, thereby unlocking the blade.

17 Claims, 12 Drawing Sheets

(56) References Cited

U.S. PATENT DOCUMENTS

| | | | | |
|---|---|---|---|---|
| 6,675,484 | B2 * | 1/2004 | McHenry | B26B 1/046 30/161 |
| 7,140,110 | B2 | 11/2006 | Lake | |
| 7,231,718 | B2 | 6/2007 | Outen | |
| 7,243,430 | B1 * | 7/2007 | Lerch | B26B 1/046 30/159 |
| 7,246,441 | B1 | 7/2007 | Collins | |
| 7,293,360 | B2 | 11/2007 | Steigerwalt et al. | |
| 7,409,766 | B2 | 8/2008 | Steigerwalt | |
| 7,437,822 | B2 | 10/2008 | Flagg et al. | |
| 7,555,839 | B2 | 7/2009 | Koelewyn | |
| 7,752,759 | B2 * | 7/2010 | Perreault | B26B 1/044 30/155 |
| 8,375,589 | B2 | 2/2013 | Bremer et al. | |
| 8,813,368 | B2 | 8/2014 | VanHoy | |
| 9,364,957 | B2 * | 6/2016 | Lake | B26B 1/044 |
| 9,833,912 | B2 * | 12/2017 | Ikoma | B26B 1/046 |
| 10,035,272 | B2 * | 7/2018 | Bruhns | B26B 1/044 |
| 10,131,059 | B2 * | 11/2018 | Ikoma | B26B 1/048 |
| 2003/0126745 | A1 * | 7/2003 | Moizis | B26B 1/044 30/160 |
| 2006/0230620 | A1 | 10/2006 | Steigerwalt et al. | |
| 2006/0260137 | A1 * | 11/2006 | Flagg | B26B 1/044 30/160 |
| 2007/0137047 | A1 | 6/2007 | Kim | |
| 2014/0115899 | A1 | 5/2014 | Frazer | |
| 2016/0075037 | A1 | 3/2016 | Ikoma | |
| 2017/0232622 | A1 | 8/2017 | Bruhns | |
| 2018/0036893 | A1 * | 2/2018 | Ikoma | B26B 1/046 |

OTHER PUBLICATIONS

Office Action from the United States Patent & Trademark Office in co-pending U.S. Appl. No. 14/855,179, dated Mar. 9, 2017.

Notice of Allowance from the United States Patent & Trademark Office in co-pending U.S. Appl. No. 14/855,179, dated Jul. 31, 2017.

* cited by examiner

FOLDING KNIFE WITH LOCKING MECHANISM

CROSS REFERENCE TO RELATED APPLICATIONS

The present application is a continuation of U.S. patent application Ser. No. 14/855,179, filed Sep. 15, 2015 now U.S. Pat. No. 9,833,912, which claims the benefit of U.S. Provisional Patent Application No. 62/050,648, filed Sep. 15, 2014, both of which applications are incorporated herein by reference.

FIELD

The present application concerns embodiments of a folding knife.

SUMMARY

Disclosed herein are folding knife embodiments that feature a locking mechanism that extends through the pivot pin of the blade. The locking mechanism can have a locking member which can reversibly engage a locking recess in the tang of the blade. The locking member can be disengaged from the blade by applying an axial force on the locking mechanism, in the direction of the pivot axis and perpendicular to the longitudinal axis of the knife handle, thereby causing the locking member to exit the locking recess of the blade.

In various embodiments, the blade can have multiple recessed areas to enable locking of the blade at multiple positions. For example, the blade can have two recessed areas to permit locking of the blade at an open blade position and at a closed blade position. In most embodiments, the open blade position and the closed blade position are 180 degrees apart along the blade's arcuate range of motion.

In one representative embodiment, a folding knife comprises a handle and a blade having a tang portion pivotally connected to the handle. The blade is operable to pivot relative to the handle about a pivot axis extending through the tang portion, between an open position and a closed position, wherein the tang portion has at least one locking recess. A locking mechanism comprises a rod that extends along the pivot axis through the tang portion and at least one locking member coupled to the rod which engages the at least one locking recess of the tang portion when the blade is in at least one of the open position or the closed position.

In another presentative embodiment, a folding knife comprises a handle and a blade having a tang portion pivotally connected to the handle, the blade being operable to pivot relative to the handle about a pivot axis extending through the tang portion, between an open position and a closed position, wherein the tang portion has first and second locking recesses. A locking mechanism comprises a rod that extends along the pivot axis through the tang portion, a connecting member mounted on the rod, and first and second locking members extending laterally from the connecting member toward the tang portion. The rod is moveable laterally along the pivot axis to move the first and second locking members relative to the tang portion. When the blade is in the open position, the first locking member engages the first locking recess and the second locking member engages the second locking recess to retain the blade in the open position.

In another representative embodiment, a folding knife comprises a handle comprising first and second liners, the first liner having first and second openings, the second liner having an opening. A blade has a tang portion pivotally connected to the handle between the first and second liners, the blade being operable to pivot relative to the handle about a pivot axis extending through the tang portion, between an open position and a closed position, wherein the tang portion has first and second locking recesses. A pivot pin extends through the tang portion and supports the blade for pivoting movement between the closed and open positions. A locking mechanism comprises a rod that extends along the pivot axis through the tang portion and the pivot pin, the rod comprising first and second end portions. The locking mechanism further comprises a connecting member mounted on the first end portion of the rod, and first and second locking members extend laterally from the connecting member toward the tang portion. A push button is connected to the second end portion of the rod, the push button and the connecting member being on opposite sides of the tang portion relative to each other. The rod is moveable laterally along the pivot axis to move the first and second locking members relative to the tang portion. When the blade is in the open position, the first locking member extends through the first opening in the first liner, the first locking recess, and into the opening in the second liner, and the second locking member extends through the second opening in the first liner and into the second locking recess. A spring is disposed on the rod and is configured to urge the first and second locking members into engagement with the first and second locking recesses when the blade is in the open position, wherein pushing the push button toward the tang portion against the spring is effective to push the first and second locking members out of engagement with the first and second locking recesses.

Additional details relating to this disclosure are set forth below in the context of certain representative embodiments that are not intended to be limiting in any way.

DETAILED DESCRIPTION

As used herein, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

The things and methods described herein should not be construed as being limiting in any way. Instead, this disclosure is directed toward all novel and non-obvious features and aspects of the various disclosed embodiments, alone and in various combinations and sub-combinations with one another. The disclosed things and methods are not limited to any specific aspect or feature or combinations thereof, nor do the disclosed things and methods require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and method. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Figure 1:
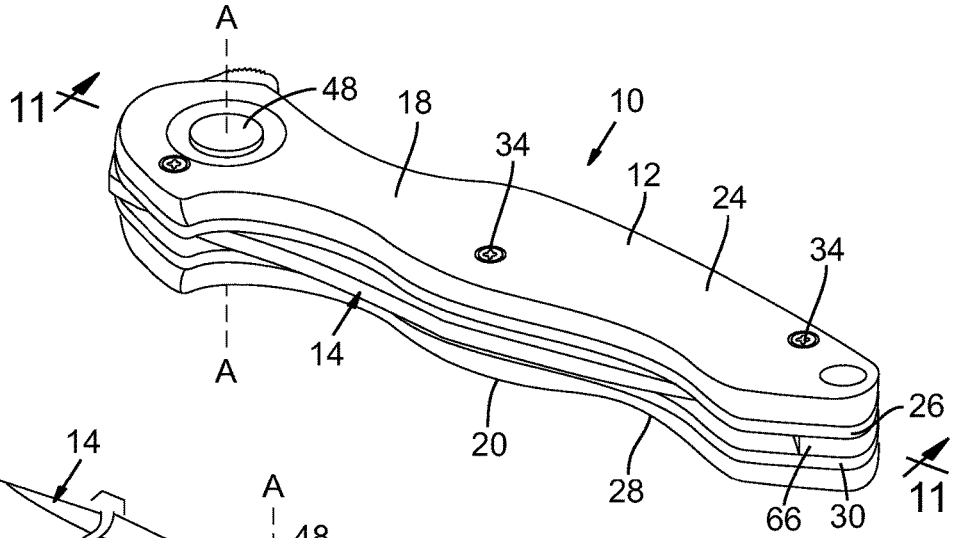
FIG. 1 is a perspective view of a folding knife, according to one embodiment, with the blade shown in the closed position.
Figure 2:
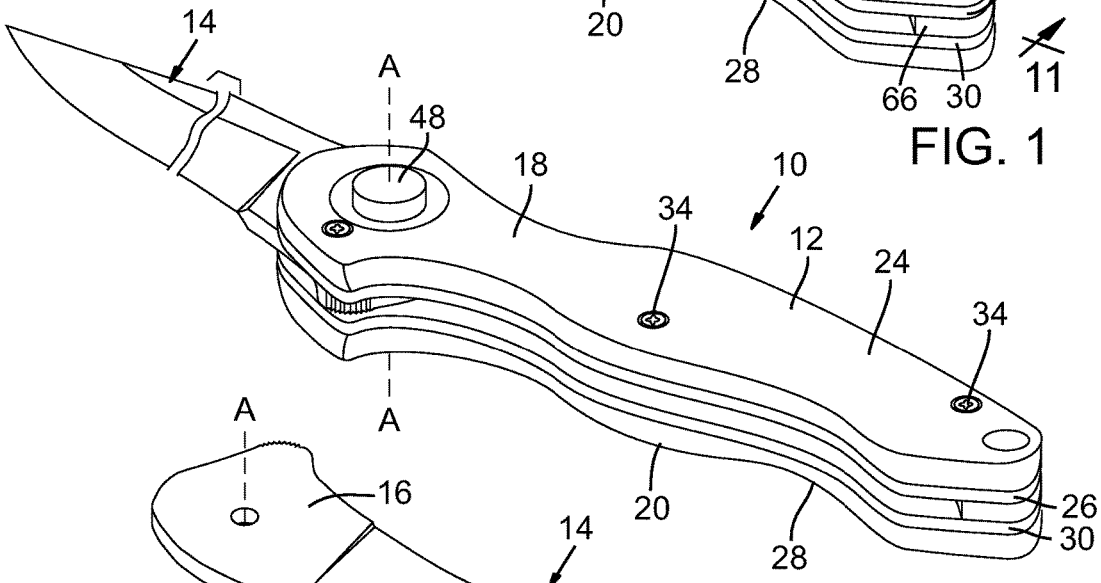
FIG. 2 is a perspective view of the folding knife of FIG. 1, shown with the blade in the open position.
Figure 4:
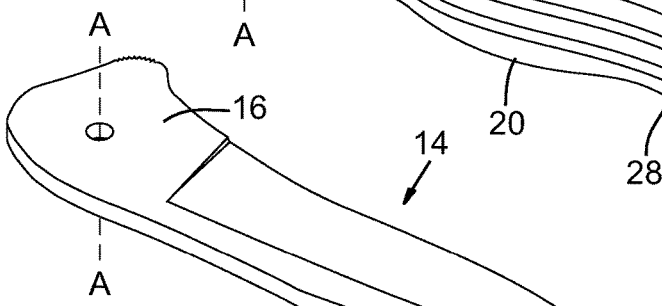
FIG. 4 is a perspective view of the blade of the folding knife of FIG. 1, according to one embodiment.

Referring first to the FIGS. 1-13, there is shown a folding knife 10, according to one embodiment. The knife 10 comprises a handle 12 and a blade 14 (FIG. 4) pivotally coupled to the handle at a base or tang portion 16 of the blade 14. The handle 12 of the knife 10 can comprise a first half 18 (first handle portion) and a second half 20 (second handle portion) with the blade 14 disposed there-between. The blade 14 can be pivotable about a pivot axis A between a closed (i.e., folded) position (FIG. 1) and an open position for use (FIG. 2).

The blade 14 can be pivotally coupled to the handle 12 by a pivot assembly extending through the tang portion 16. The pivot assembly can comprise a pivot pin 32. The pivot pin 32 can comprise an internal channel or bore 33 (FIG. 6) through which another pin 40 (also referred to as a rod or shaft) can extend. The pin 40 in the illustrated embodiment is cylindrical and has a circular cross-section, although other non-circular cross-sectional shapes are possible (e.g., square). The first handle portion 18 can comprise a first outer side panel or plate 24 (i.e., a first side panel) and a first inner liner portion 26, and the second handle portion 20 can comprise a second outer side panel or plate 28 (i.e., a second side panel) and a second inner liner portion 30. The first and second side panels 24 and 28 can be secured to the first and second liner portions 26 and 30, respectively, by the pivot assembly, as well as by additional screws 34 located along the length of the first and second side panels 24 and 28, as shown in FIGS. 1 and 2.

Figure 3:
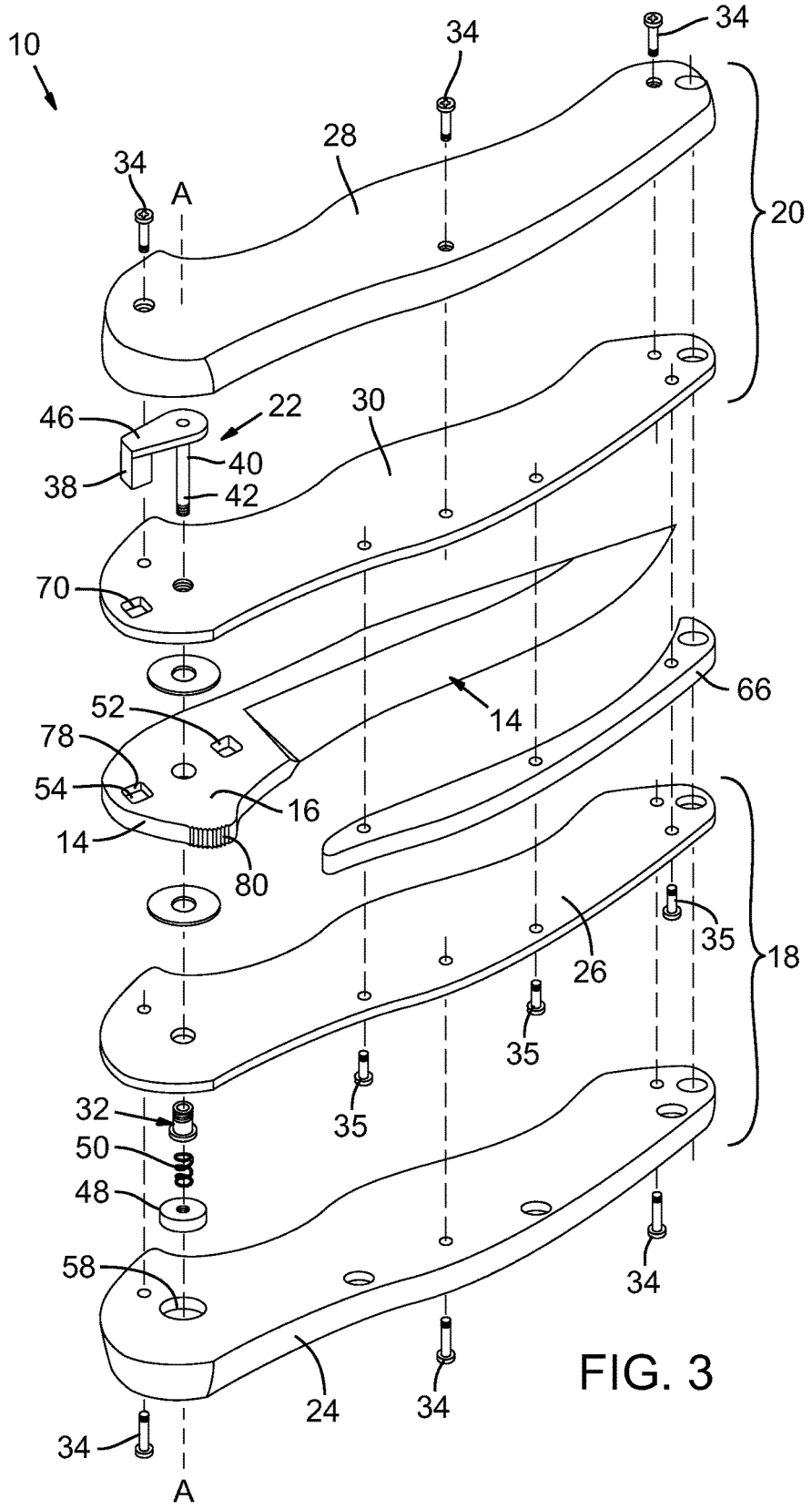
FIG. 3 is a perspective, exploded view of the folding knife of FIG. 1, shown with the blade in the closed position.
Figure 8:
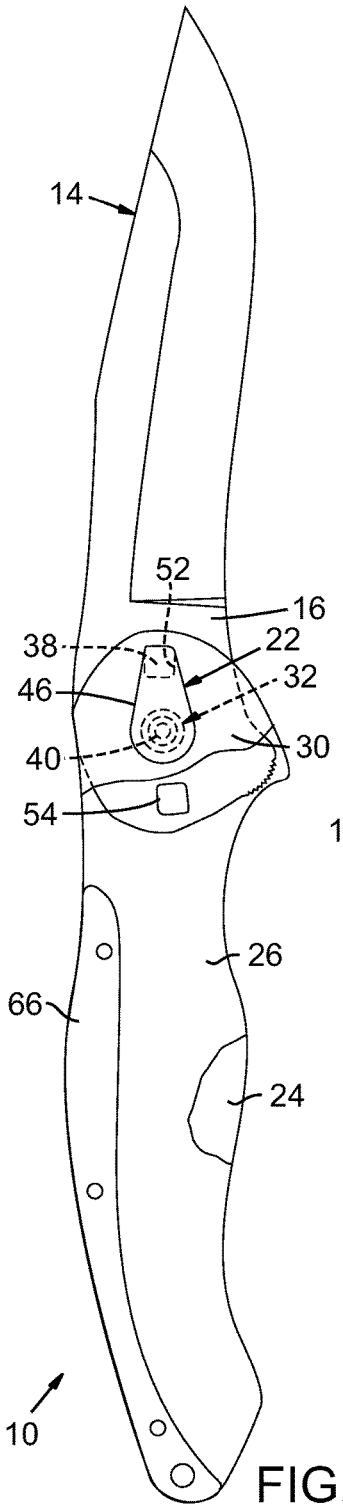
FIG. 8 is a side view of the folding knife of FIG. 1, shown with the blade in the open and locked configuration. A side panel of the handle is removed for clarity of illustration.
Figure 6:
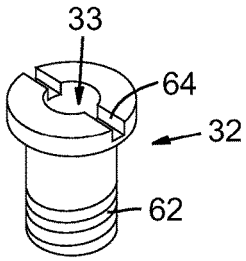
FIG. 6 is a perspective view of a pivot pin, according to one embodiment, which can be used in the folding knife of FIG. 1.

The knife 10 can further comprise a spacer or spline 66 located between the liners 26, 30 (FIG. 3). Additional screw(s) 35 can be passed through the spacer 66 to secure it to the first and second liner portions 26, 30 of the first and second handle portions 18, 20.

Figure 11A:
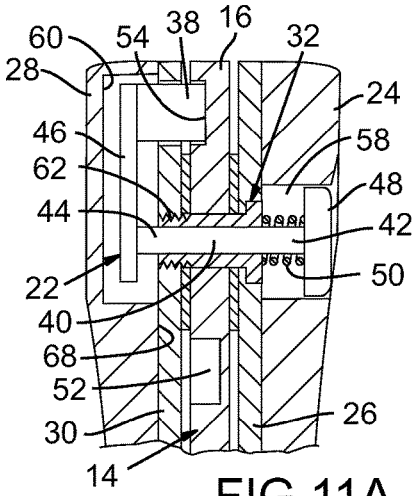
FIG. 11A is an enlarged, cross-sectional view of the folding knife of FIG. 11 in the vicinity of the blade tang portion.
Figure 11:
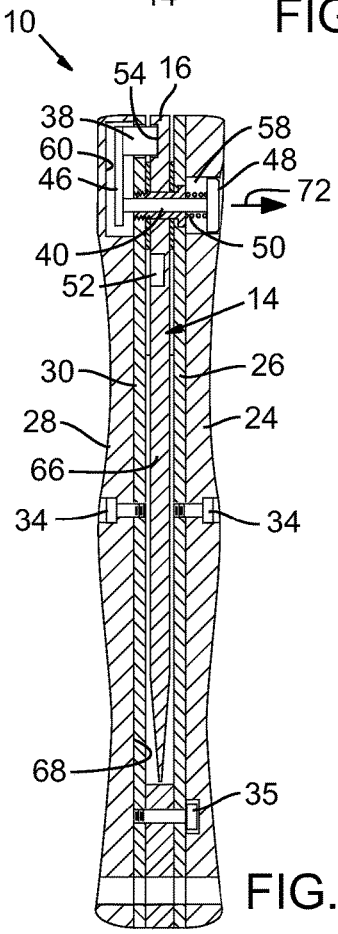
FIG. 11 is a longitudinal cross-sectional view of the folding knife of FIG. 1, taken through line 11-11 of FIG. 1, shown with the blade in the closed and locked configuration.
Figure 12:
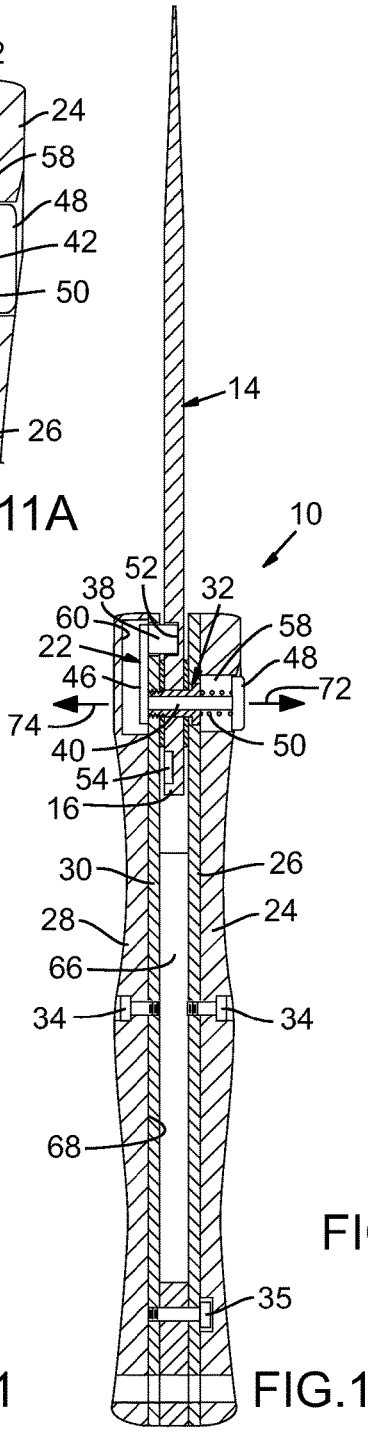
FIG. 12 is a cross-sectional view of the folding knife of FIG. 1, taken through line 11-11, shown with the blade in the open and locked configuration.
Figure 13:
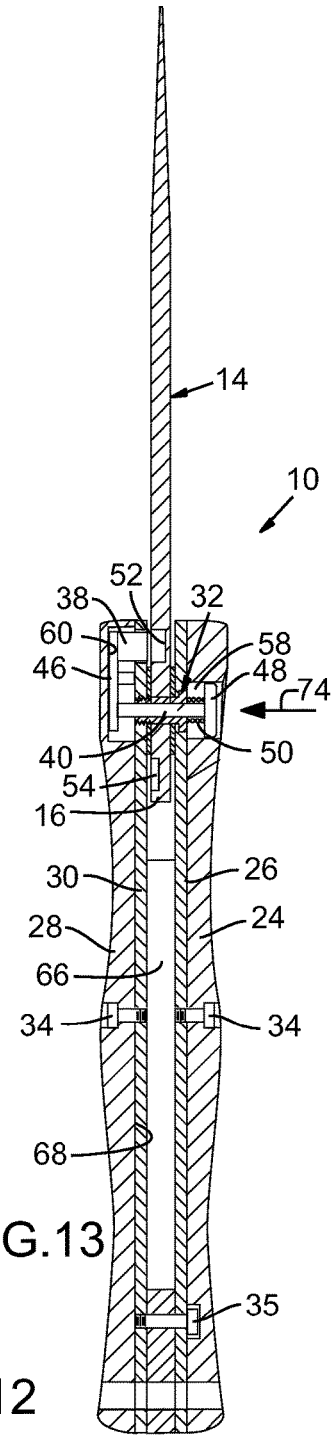
FIG. 13 is a cross-sectional view of the folding knife of FIG. 1, taken through line 11-11, shown with the blade in the open and unlocked configuration.

As shown in FIGS. 11-13, the pivot pin 32 can extend through an opening in the first liner portion 26, an opening in the tang portion 16 of the blade 14, and an opening in the second liner portion 30, thereby stably holding these components together. In the illustrated embodiment, the pivot pin 32 further comprises external threading 62 configured to engage internal threading of the second liner portion 30, and a groove 64 along its head for engaging a tool, such as a screwdriver, for assembly or disassembly of the knife. As shown, the part of the tang portion 16 which receives the pivot pin 32 can be made thicker than the rest of the tang portion 16 and/or the rest of the blade 14.

The knife 10 can be manufactured using known methods of manufacture from any of various known materials. The components of the handle portion 12 can be constructed from any of various metals, metal alloys and/or polymers. The blade 14 can be constructed from, for example, stainless steel or any of various other suitable metals or alloys.

Figure 7:
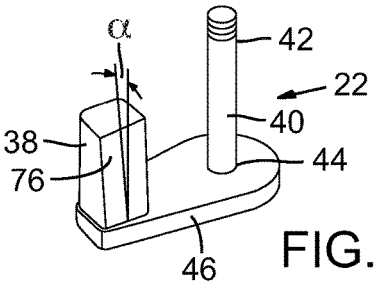
FIG. 7 is a perspective view of a locking mechanism, according to one embodiment, which can be used in the folding knife of FIG. 1.
Figure 9:
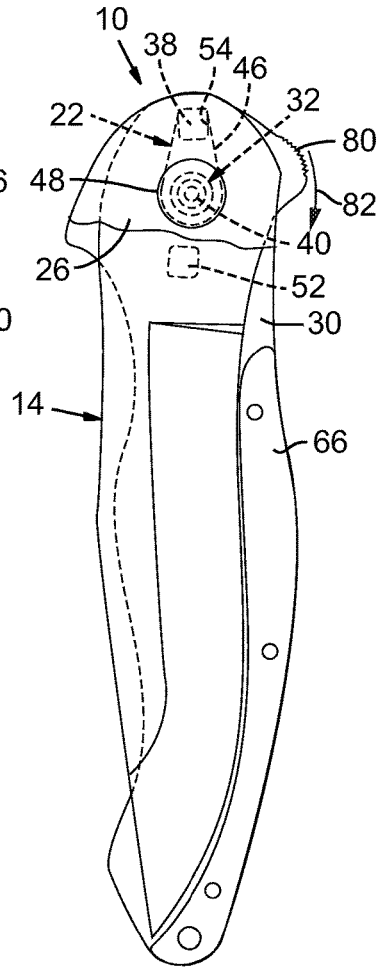
FIG. 9 is a side view of the folding knife of FIG. 1, taken from the opposite side as compared to FIG. 8 and shown with the blade in the closed and locked configuration. A side panel of the handle is removed for clarity of illustration.
Figure 10:
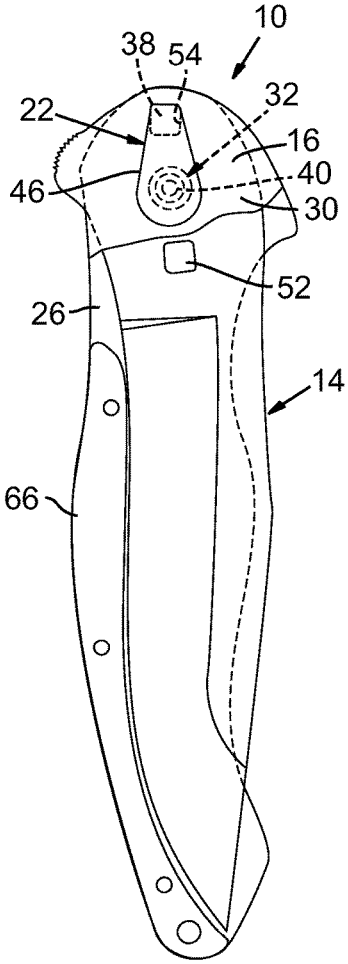
FIG. 10 is a side view of the folding knife of FIG. 1, taken from the opposite side as compared to FIG. 9 and shown with the blade in the closed and locked configuration. A side panel of the handle is removed for clarity of illustration.

The knife 10 further comprises a blade locking assembly, or locking mechanism, 22 mounted within the handle adjacent the blade tang 16 for locking the blade 14 in the closed and/or open position. As best shown in FIG. 7, the locking assembly 22 can comprise a laterally extending locking member 38 (also referred to as a locking element or locking pin), an elongated rod or shaft 40 having a first end portion 42 and a second end portion 44, and a connecting portion 46 (also referred to as a connecting arm or arm). As best shown in FIG. 11A, the rod 40 is configured to extend through the channel 33 of the pivot pin 32, which in turn extends through a corresponding opening in the tang portion 16 of the blade 14. The first end portion 42 can extend at least partially through the first handle portion 18, while the second end portion 44 can extend at least partially through the second handle portion 20. The connecting arm 46 can extend longitudinally (along the axis of the handle 12) from the second end portion 44 to the locking member 38 and is secured at its opposite ends to these components. The locking member 38 can project laterally away from the connecting portion 46, parallel to the rod 40, in a direction toward the blade 14 and the first end portion 42.

Figure 5:
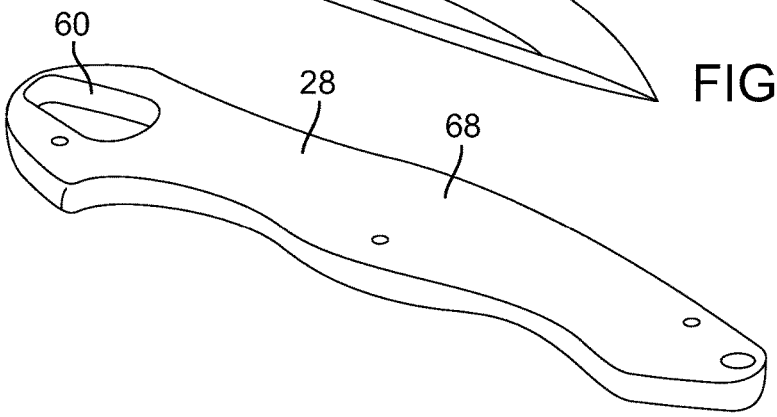
FIG. 5 is a perspective view of a side panel of a handle of the folding knife of FIG. 1.

A push button 48 can be secured to the first end portion 42 of the pin 40. As best shown in FIG. 7, the first end portion 42 can have external threads that engage internal threads (not shown) of the push button 48. As best shown in FIG. 3, the first side panel 24 can be formed with an opening or aperture 58 in which the button 48 is disposed. As best shown in FIG. 5, the inner surface 68 of the second side panel 28 can be formed with a recess or notch 60 that is sized to receive the connecting arm 46 of the locking assembly 22. The recess 60 can be shaped complementary to the connecting arm 46, and may include contoured edges. However, in other embodiments, the recess 60 can be replaced by an aperture that extends through the full thickness of the second side panel 28.

The locking assembly 22 is movable laterally side-to-side along the pivot axis A of the blade 14 between an unlocked position and a locked position. As best shown in FIG. 11A, a biasing element, such as the illustrated coil spring 50, can be coaxially disposed around the pin 40 within the aperture 58 of the first side panel 24. One end of the spring 50 bears against an inner surface of the button 48 and the opposite end of the spring 50 bears against an opposing surface of the pivot pin 32. In this manner, the spring 50 biases the button 48 (and the locking member 38) to a locked position when manual pressure is released from the button, as further described below. Other types of biasing mechanism also can be used, such as a flat leaf spring, an omega-shaped spring, etc.

Referring again to FIG. 3, the blade tang 16 can be formed with a first locking recess, notch, or opening 52 and a second locking recess, notch, or opening 54, which desirably are positioned about 180 degrees apart from each other relative to the pivot axis A. The first and second locking recesses 52, 54 are sized and shaped to receive the locking member 38 when the blade 14 is in the open position and closed position, respectively. As best shown in FIG. 11A, these recesses can occupy a portion of the thickness of the tang portion 16 of the blade 14. However, in alternative embodiments, one or both of these recesses can be replaced with aperture(s) that extend through the entire thickness of the tang portion 16, without affecting the basic functionality of the locking assembly 22. The second inner liner portion 30 can have an aperture 70 through which the locking member 38 can extend to engage the locking recesses 52, 54 in the blade 14 when the locking assembly is in the locked position.

Referring again to FIGS. 11-13, the operation of the locking assembly 22 will now be described. FIG. 11 shows the blade 14 in a closed and locked position. In this position, the biasing force of the spring 50 biases the locking assembly 22 laterally toward the first side panel 24 in the direction of arrow 72, such that the locking member 38 extends through the aperture 70 in the second liner 30 and into the second locking recess 54. The engagement of the locking member 38 with the second locking recess 54 maintains the blade 14 in the closed position. To pivot the blade to its open position (FIG. 12), the manual pressure is applied to the button 48 toward the second side panel 28 in the direction of arrow 74 until the locking member 38 is removed from the second locking recess 54, at which point the blade is free to pivot to the open position.

When the blade is in the open position, manual pressure on the button 48 can be released, which allows the spring 50 to urge the locking member 38 back toward the locked position (in the direction of arrow 72) such that the locking member 38 extends through the aperture 70 and into the first locking recess 52 (as depicted in FIG. 12). It should be noted that when pivoting the blade from the closed position to the open position, manual pressure on the button 48 can be released as soon as the second locking recess 54 is pivoted past the locking member 38. In this manner, the locking member 38 can slide against the side surface of the blade tang 16 until the blade reaches its fully open position and the first locking recess 52 becomes aligned with the locking member 38, at which point the locking member 38 can engage the first locking recess 52 under the force of the spring 50. In order to close the blade from its open position, the button 48 is pressed in the direction of arrow 74 sufficient to remove the locking member 38 from the first locking recess 52 (as depicted in FIG. 13). In this position, the locking member 38 no longer restricts pivoting movement of the blade.

As shown, the first locking recess 52 of the blade 14 can be deeper (in the direction of the thickness of the blade) than the second locking recess 54. As a result, the push button 48 may project further outward when the blade is in the open and locked configuration (FIGS. 2 and 12), as compared to when the blade is in the closed and locked configuration (FIGS. 1 and 11). As a result, the push button may need to be depressed to a greater extent to unlock the blade while the blade is in the open position, as compared to when the blade 14 is in the closed position. However, in other embodiments, the second recess 54 may be deeper than the first recess 52, or the recesses may be of substantially equivalent size.

In particular embodiments, as shown in FIG. 7, the locking member 38 can include an angled or ramped cam surface 76 such that the locking member 38 is tapered extending in a direction from its end adjacent the connecting portion 46 toward the opposite end of the locking member. The cam surface 76 forms an angle α with a line that is parallel to the opposing surface of the locking member and perpendicular to the connecting portion 46. In particular embodiments, the angle α can be in the range of about 1 degree to about 80 degrees, or in the range of about 1 degree to about 45 degrees, with 8 degrees being a specific example.

The opening 54 can have a correspondingly shaped angled or ramped cam surface 78 (FIG. 3) that mates with cam surface 76 when the blade 14 is in the closed position. When the blade is in the closed and locked position, the spring 50 desirably provides sufficient force to hold the blade in the closed and locked position at least against gravity (prevents opening under the weight of the blade). By virtue of cam surface 76 engaging cam surface 78, pivoting motion of the blade toward the open position is effective to push the locking member 38 out of the opening 54 against the bias of the spring 50 (without applying a manual force to the button 48). To further facilitate opening of the blade, the tang portion 16 can include a projection 80 (FIGS. 3 and 9) (known as a "flipper") that extends outwardly from the back edge of the handle 12 when the blade is in the closed position. While holding the knife in one hand, opening of the blade can be accomplished by pressing against the projection 80 with a finger of the same hand in the general direction of arrow 82.

In alternative embodiments, the blade 14 may be provided with only one locking recess. For example, the blade 14 may have only a single locking recess 52 for locking the blade in the open position. Alternatively, the blade 14 may have only a single locking recess 54 for locking the blade in the closed position.

Figures 14, 15, 16:
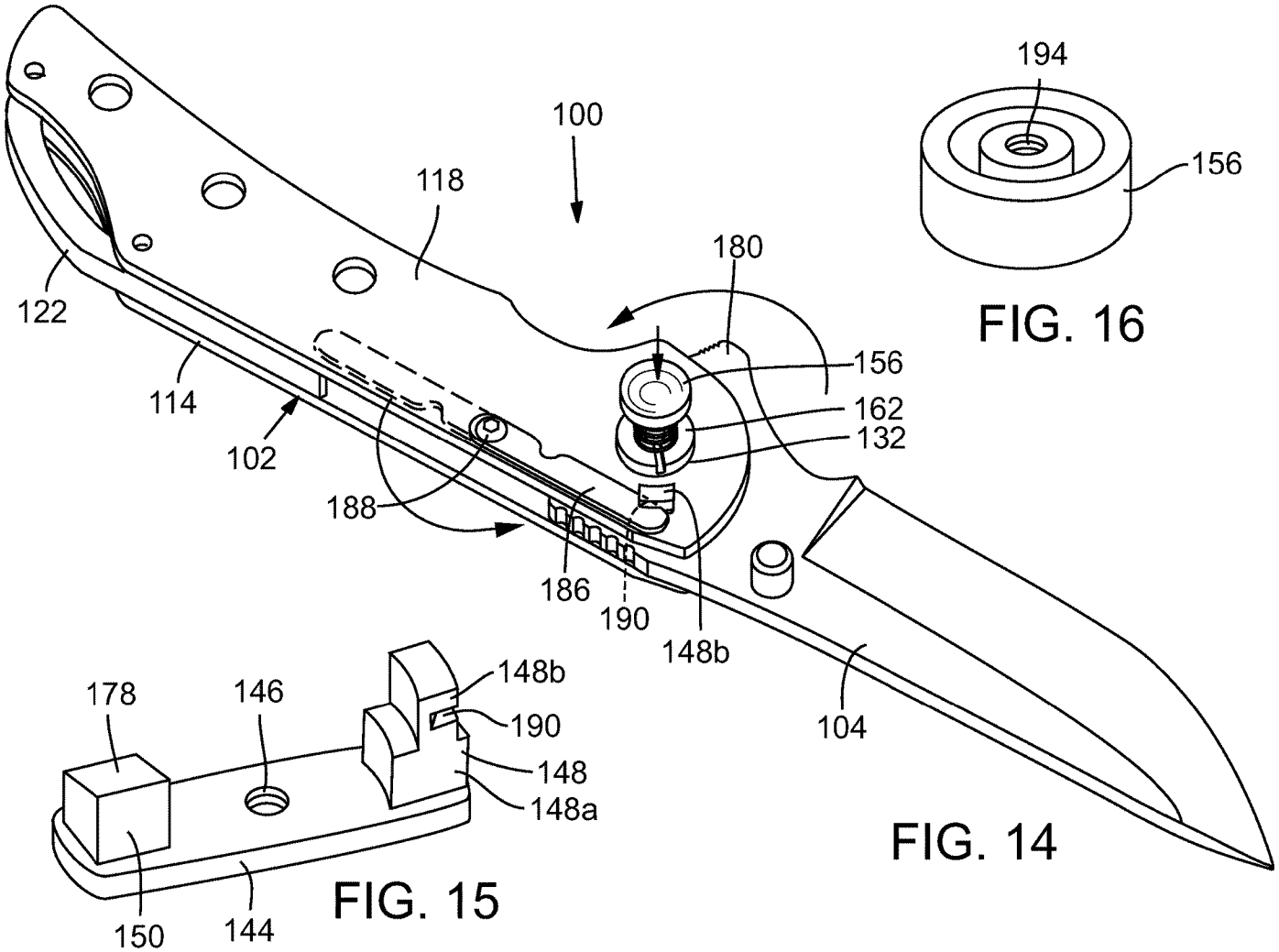
FIG. 14 is a perspective view of a folding knife, according to another embodiment, with the blade shown in the open position.
FIG. 15 is a perspective view of a locking mechanism, according to another embodiment, which can be used in the folding knife of FIG. 14.
FIG. 16 is a perspective view of a push button that can be implemented in the folding knife of FIG. 14.
Figure 17:
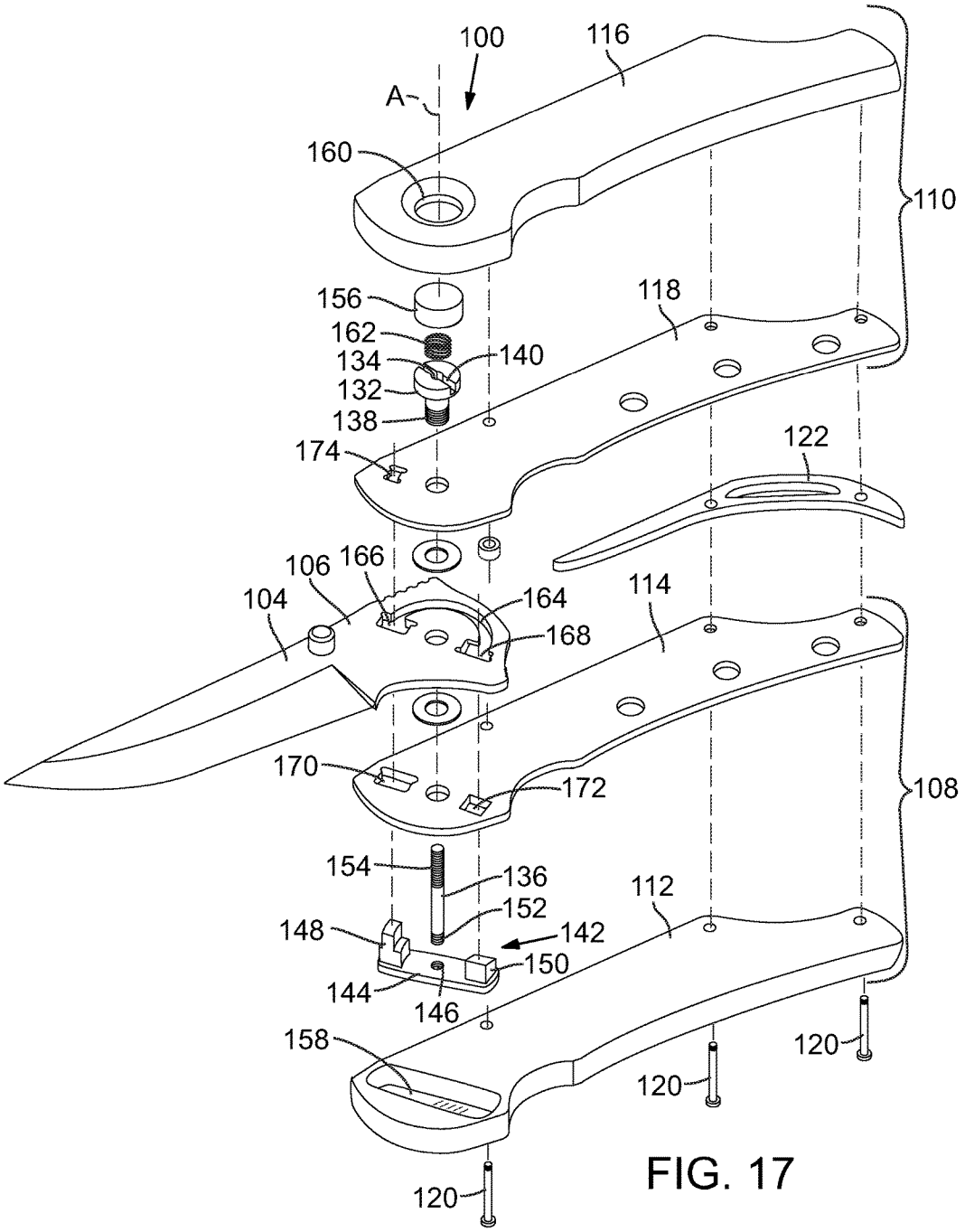
FIG. 17 is a perspective, exploded view of the folding knife of FIG. 14, shown with the blade in the open position.

Referring now to the FIGS. 14-26, there is shown a folding knife 100, according to another embodiment. As best shown in FIGS. 14 and 17, the knife 100 comprises a handle 102 and a blade 104 pivotally coupled to the handle at a base or tang portion 106 (also referred to as a tang) of the blade 104. The handle 102 of the knife 10 can comprise a first half 108 (first handle portion) and a second half 110 (second handle portion) with the blade 104 disposed there-between. The blade 104 can be pivotable about a pivot axis A between a closed (i.e., folded) position (FIG. 18) and an open position for use (FIGS. 14 and 19).

The blade 104 can be pivotally coupled to the handle 102 by a pivot assembly extending through the tang portion 106. The pivot assembly can comprise a pivot pin 132. The pivot pin 132 can comprise an internal channel or bore 134 (FIG. 21) through which another pin 136 (also referred to as a shaft or rod) can extend. As best shown in FIG. 17, the first handle portion 108 can comprise a first outer side panel or plate 112 (i.e., a first side panel) and a first inner liner portion or liner 114, and the second handle portion 110 can comprise a second outer side panel or plate 116 (i.e., a second side panel) and a second inner liner portion or liner 118. The first and second side panels 112 and 116 can be secured to the first and second liner portions 114 and 118, respectively, by the pivot assembly, as well as by additional screws 120 located along the length of the first and second side panels 112 and 116, as best shown in FIG. 17. In FIG. 14, the first and second side panels 112, 116 are removed for purposes of illustration.

The knife 100 can further comprise a spacer or spline 122 located between the liners 114, 118. Additional screw(s) 120 can be passed through the spacer 122 to secure it to the first and second liner portions 114, 118 of the first and second handle portions 108, 110.

Figure 21:
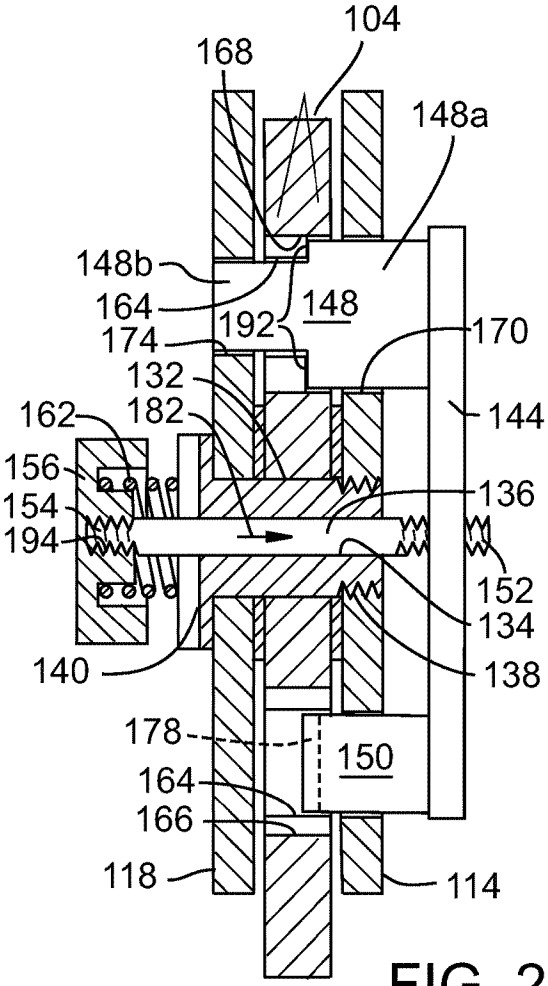
FIG. 21 is an enlarged cross-sectional view of a portion of the folding knife of FIG. 14, taken through line 21-21 of FIG. 18, showing the blade in the closed position.

As shown in FIG. 21, the pivot pin 132 can extend through an opening in the first liner portion 114, an opening in the tang portion 106 of the blade 14, and an opening in the second liner portion 118, thereby stably holding these components together. In the illustrated embodiment, the pivot pin 132 further comprises external threading 138 configured to engage internal threading of the first liner portion 114, and a groove 140 (FIG. 17) along its head for engaging a tool, such as a screwdriver, for assembly or disassembly of the knife. As shown, the part of the tang portion 106 which receives the pivot pin 132 can be made thicker than the rest of the tang portion 106 and/or the rest of the blade 104.

The knife 100, like knife 10, can be manufactured using known methods of manufacture from any of various known materials. The components of the handle portion 102 can be constructed from any of various metals, metal alloys and/or polymers. The blade 104 can be constructed from, for example, stainless steel or any of various other suitable metals or alloys.

The knife 100 further comprises a blade locking assembly, or locking mechanism, 142 mounted within the handle adjacent the blade tang 106 for locking the blade 104 in the closed and/or open position. As best shown in FIG. 17, the locking assembly 142 can comprise an elongated bar or plate 144 (also referred to as a connecting member) mounted on a first end portion 152 of the inner shaft 136, such as by external threads on the end portion 152 of the inner shaft 136 that engage internal threads of an opening 146 of the plate 144. Extending from opposite ends of the plate 144 are a first laterally extending locking member 148 (also referred to as a locking element or locking pin) and a second laterally extending locking member 150 (also referred to as a locking element or locking pin). The first locking member 148 can be formed with an enlarged base portion **148*a* and narrower end portion 148*b* having a smaller width than the base portion 148*a*. A step or shoulder 192 is defined at the intersection of the base portion 148*a* and the end portion 148*b***.

As best shown in FIG. 21, the rod 136 is configured to extend through the channel 134 of the pivot pin 132, which in turn extends through a corresponding opening in the tang portion 106 of the blade 104. A push button 156 can be mounted on a second end portion 154 of the rod 136, such as by external threads on the second end portion 154 that engage internal threads 194 of an opening of the push button. The locking members 148, 150 can project laterally away from the plate 144, parallel to the rod 136, in a direction toward the blade 104.

The locking assembly 142 is movable laterally side-to-side along the pivot axis A of the blade 104 between an unlocked position and a locked position. A biasing member, such as a compression spring 162 can be disposed on the rod 136 between the push button 156 and the head of the pivot pin 132. One end of the spring 162 bears against an inner surface of the push button and the opposite end of the spring 162 bears against an opposing surface of the pivot pin 132. In this manner, the spring 162 biases the button 156 (and the locking assembly 142) to a locked position when manual pressure is released from the button, as further described below.

As best shown in FIG. 17, the first side panel 112 can be formed with an opening or recessed portion 158 that is sized to receive the plate 144. The recessed portion 158 can be shaped complementary to the plate 144, and may include contoured edges. The second side panel 116 can be formed with an opening 160 in which the push button 156 is disposed.

The blade tang 106 can be formed with an arcuate slot 164, which, for example, forms a 180-degree arc around the pivot pin 132. The opposite ends of the slot 164 form a first locking recess, notch, or opening 166 and a second locking recess, notch, or opening 168, which desirably are positioned about 180-degrees apart from each other relative to the pivot axis A. The first and second locking recesses 166, 168 are sized and shaped to receive the first and second locking members 148, 150 in the closed and open positions, as further described below. The first inner liner 114 can have first and second apertures 170, 172, respectively, through which the locking members 148, 150 can extend to engage the locking recesses 166, 168. The second inner liner 118 can have an aperture 174 sized to receive the end portion 148*b* of the first locking member 148.

Figure 18:
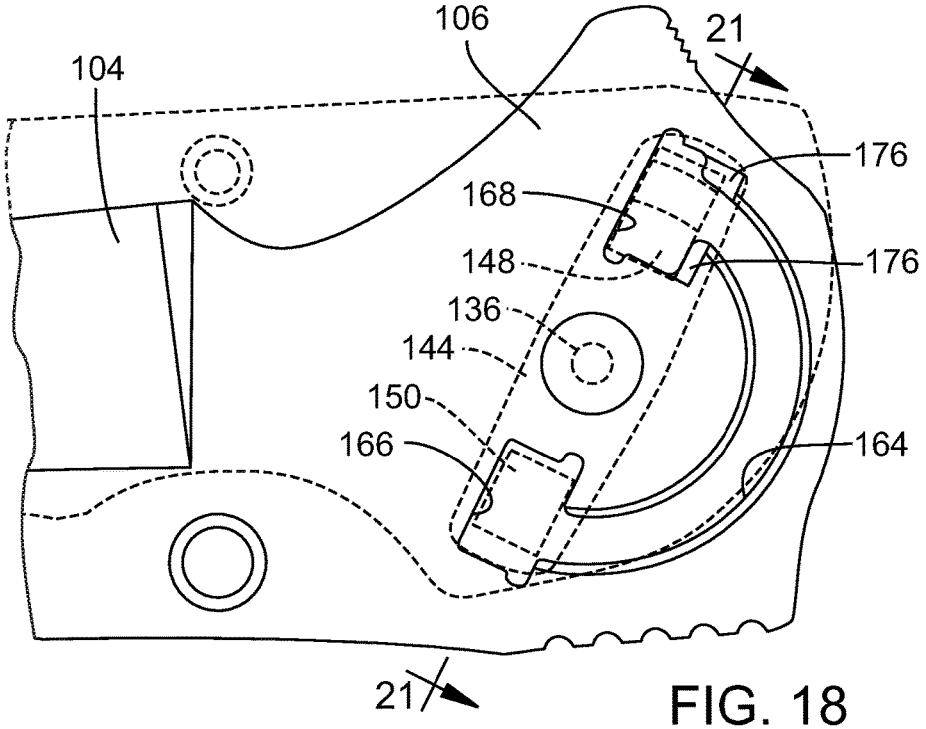
FIG. 18 is an enlarged side view of a portion of the folding knife of FIG. 14, showing the blade in the closed position.
Figure 19:
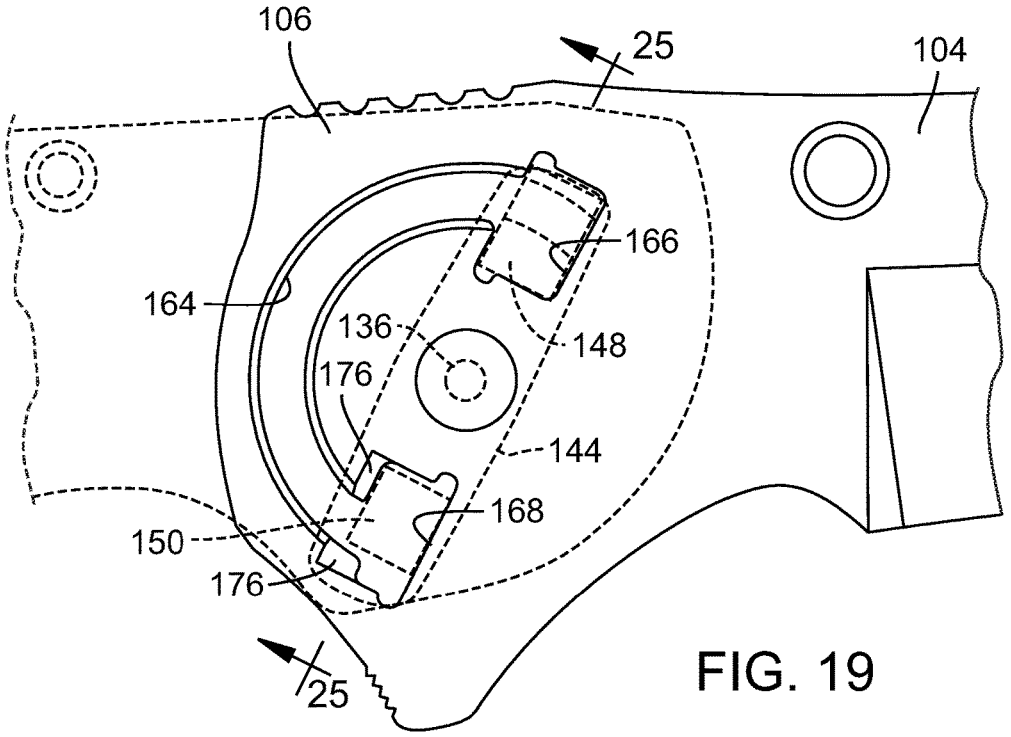
FIG. 19 is an enlarged side view of a portion of the folding knife of FIG. 14, showing the blade in the open position.

Referring to FIGS. 18-19 and 21-26, the operation of the locking assembly will now be described. FIGS. 18 and 21 show the blade 104 in a closed position. In this position, the biasing force of the spring 162 biases the locking assembly 142 laterally toward the second side panel 116, such that the first locking member 148 extends through the first aperture 170 in the first inner liner 114 and into the second locking recess 168, and the second locking member 150 extends through the second aperture 172 in the first inner liner 114 and into the first locking recess 166. The end portion 148*b* of the first locking member 148 can extend into the aperture 174 in the second inner liner 118.

Figure 20:
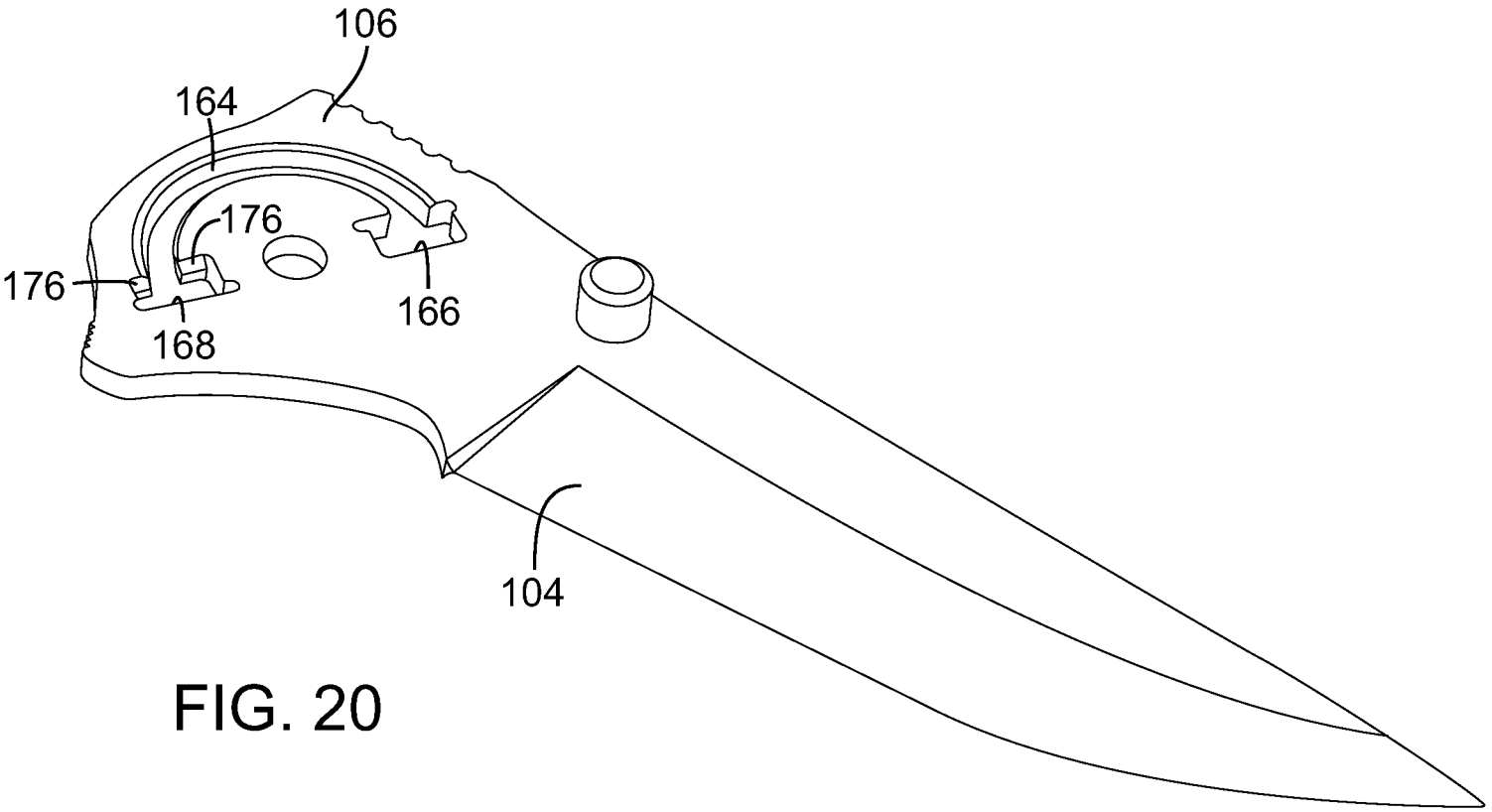
FIG. 20 is a perspective view of a blade of the folding knife of FIG. 14.
Figure 23:
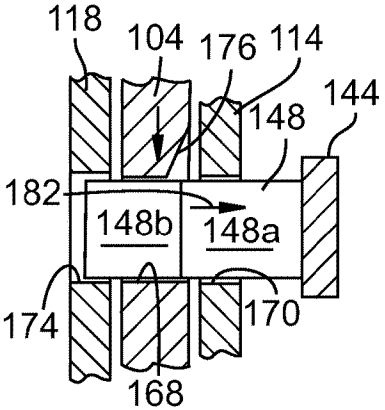
FIG. 23 is enlarged cross-sectional view of the folding knife of FIG. 14, taken through line 23-23 of FIG. 22.
Figure 24:
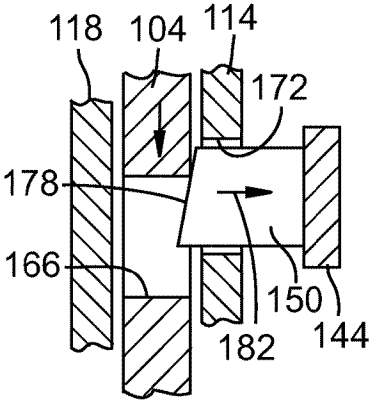
FIG. 24 is enlarged cross-sectional view of the folding knife of FIG. 14, taken through line 24-24 of FIG. 22.

The locking members 148, 150 and/or the locking recesses 166, 168 can be formed with cam surfaces that maintain the blade 104 in the closed position under its own weight yet allow the blade 104 to be pivoted away from the closed position with manual pressure or force applied to the blade without depressing the push button 156. For example, as best shown in FIGS. 20 and 23, the second locking recess 168 can be formed with angled or inclined cam surfaces 176 that engage the shoulder 192 on the base portion 148*a* of the first locking member 148. As best shown in FIGS. 15 and 24, the second locking member 150 can be formed with an angled or inclined cam surface 178 that engages an adjacent surface of the first locking recess 166. The base portion 148*a* (e.g., the shoulder 192) and the first locking recess 166 also can be formed with complementary cam surfaces that engage cam surfaces 176, 178. The cam surfaces 176, 178 are inclined at an angle greater than zero with respect to a plane parallel to the side of the blade tang 106 (i.e., the cam surfaces are not parallel with the side of the blade tang).

Figure 22:
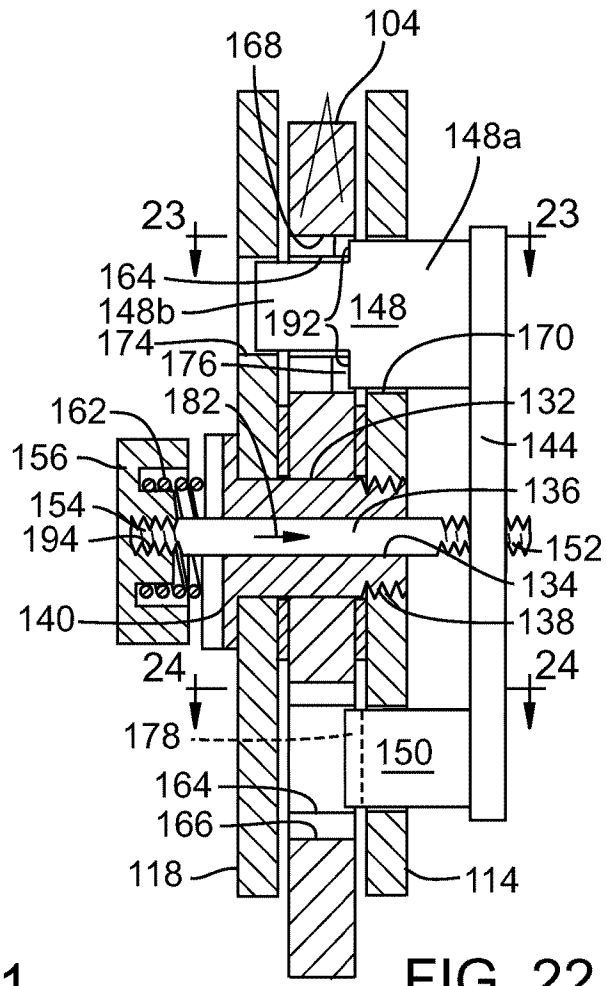
FIG. 22 is an enlarged cross-sectional view of a portion of the folding knife similar to FIG. 21, showing the locking members of the locking mechanism removed from locking recesses on the blade.

When the blade is in the closed position, the spring 162 desirably provides sufficient force to hold the blade in the closed position at least against gravity (prevents opening under the weight of the blade). By virtue of cam surfaces 176, 178 engaging the adjacent surfaces of the base portion 148*a* and the first locking recess 166, pivoting motion of the blade toward the open position is effective to push the base portion 148*a* of the first locking member 148 out of the second locking recess 168 and the second locking member 150 out of the first locking recess 166 against the bias of the spring 162 (without applying a manual force to the button 156) in the direction of arrow 182, as depicted in FIGS. 22-24. As the blade 104 is pivoted to the open position, the shoulder 192 of the first locking member 148 and the second locking member 150 can slide against the side surface of the blade tang 106 until the blade reaches the fully open position. The end portion 148*b* of the first locking member 148 can reside within the slot 164 of the blade as the blade is pivoted from the closed position to the open position. To further facilitate opening of the blade, the tang portion 106 can include a projection or "flipper" 180. While holding the knife in one hand, opening of the blade can be accomplished by pressing against the projection 180 with a finger of the same hand, as described above in connection with the knife 10.

Figure 25:
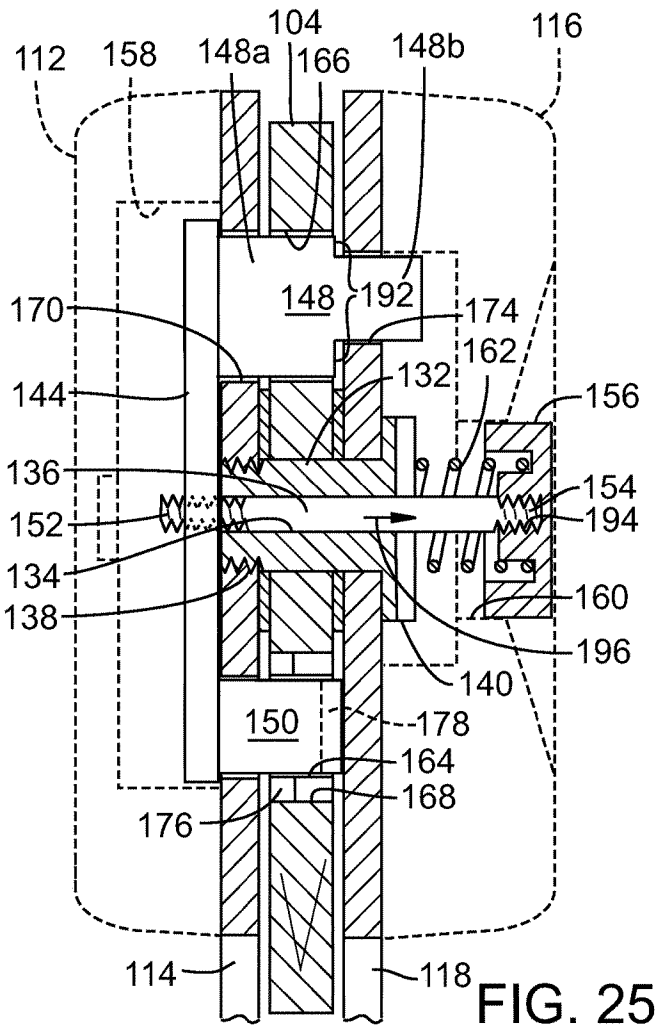
FIG. 25 is an enlarged cross-sectional view of a portion of the folding knife of FIG. 14, taken through line 25-25 of FIG. 19, showing the blade in the open and locked position.

Referring now to FIGS. 19 and 25, when the blade reaches the fully open position, the first locking member 148 becomes aligned with the first locking recess 166 and the second locking member 150 becomes aligned with the second locking recess 168. The force of the spring 162 forces the base portion 148*a* of the first locking member 148 into the first locking recess 166, and the second locking member 150 into the second locking recess 168 (in the direction of arrow 196) to hold the blade 104 in an open and locked position. More specifically, the first locking member 148 extends through the opening 170 in the first liner 114, the first locking recess 166, and the opening 174 in the second liner 118. The opening 174 in the second inner liner 118, which receives the end portion 148*b* of the first locking member 148, further assists in the retaining the blade in the open position by resisting torqueing or bending of the first locking member 148 from forces applied to the blade during use.

Figure 26:
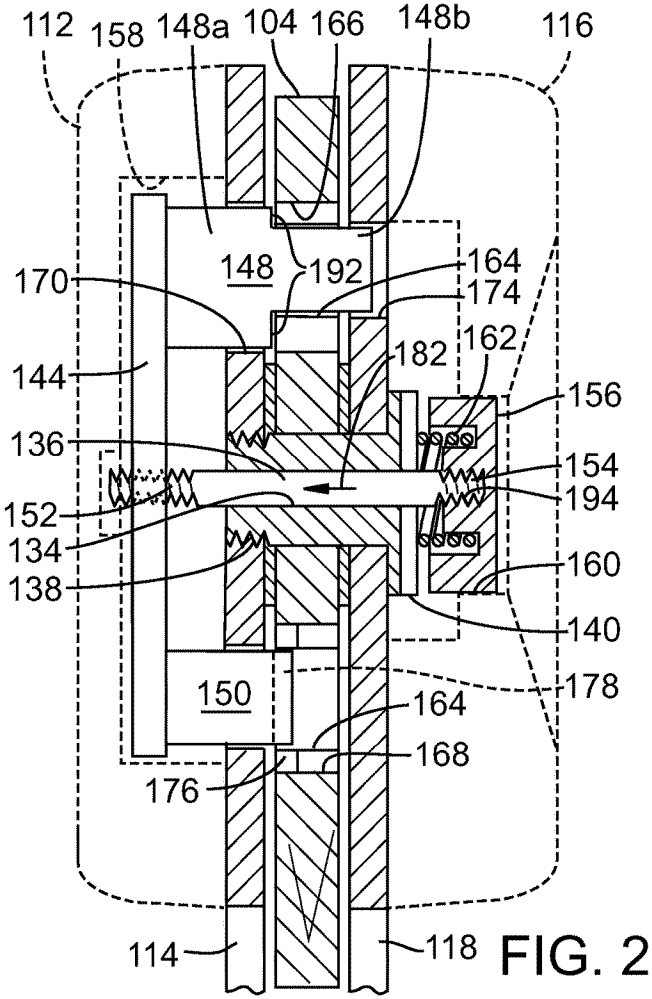
FIG. 26 is an enlarged cross-sectional view of a portion of the folding knife similar to FIG. 25, showing the locking members of the locking mechanism removed from locking recesses on the blade.

In order to close the blade from its open position, the button is pressed in the direction of arrow 182 sufficient to remove the base portion 148*a* of the first locking member 148 from the first locking recess 166 and the second locking member 150 from the second locking recess 168, as depicted in FIG. 26. In this position, the locking members 148, 150 no longer restrict pivoting movement of the blade. The end portion 148*b* of the first locking member 148 can reside within the slot 164 of the blade as the blade is pivoted from the open position to the closed position.

The knife 100 can further include a safety mechanism configured to prevent inadvertent operation of the push button 156 when the blade 104 is in the open and locked configuration. In the illustrated embodiment, as best shown in FIGS. 14 and 15, the knife 100 can have a safety mechanism 186 in the form of a lever that is pivotably connected at one end to the second inner liner 118, such as by a screw or pin 188. The end portion 148*b* of the first locking member 148 can be formed with a slot 190 sized and shaped to receive a free end portion of the safety mechanism 186. When the blade is in the open and locked configuration, the slot 190 extends laterally beyond the second inner liner 118, as best shown in FIG. 14. The safety mechanism 186 can be rotated from a release position (shown in phantom in FIG. 14) to a safety position (shown in solid lines in FIG. 14) in which the free end portion of the safety mechanism extends at least partially into the slot 190. In the safety position, the safety mechanism 186 prevents any lateral movement of the first locking member 148 (and therefore the locking assembly 142) against manual pressure applied to the push button 156. When moved to the release position, the safety mechanism 186 no longer restricts lateral movement of the locking assembly relative to the locking recesses of the blade. In alternative embodiments, the safety mechanism can be a slidable member that slides relative to the handle between the safety position and the release position.

In alternative embodiments, the knife 100 can be formed without cam surfaces 176, 178, and therefore when the blade 104 is in the closed position, the base portion 148*a* of the first locking member 148 is retained in the second locking recess 168 and the second locking member 150 is retained the first locking recess 166 and resist against inadvertent opening of the blade unless manual pressure is applied to the button 156. Opening of the blade is accomplished by pressing the button 156 in the direction of arrow 182 sufficient to remove the base portion 148*a* of the first locking member 148 from the second locking recess 168 and the second locking member 150 from the first locking recess 166. As the blade is pivoted away from the closed position, manual pressure on the button 156 can be removed as soon as the locking recesses 166, 168 are pivoted past the locking members 148, 150. In certain embodiments, the knife can be an automatic knife that has a spring or other opening mechanism that provides a biasing force to the blade that is strong enough to pivot the blade from the closed position to the position upon pressing the button 156 to remove the locking members from the locking recesses. In the closed and locked position of the blade, the locking mechanism holds the blade closed against the biasing force of the opening mechanism acting on the blade.

Figure 27:
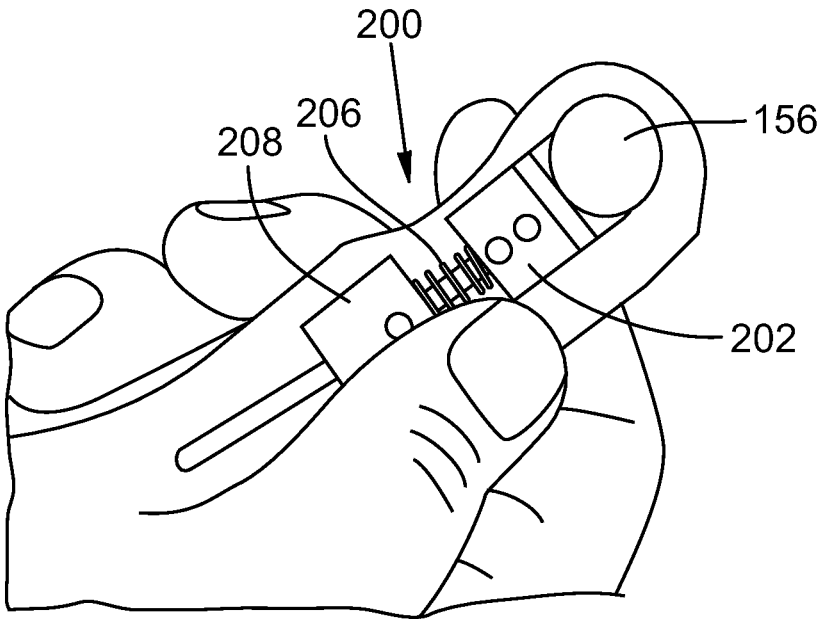
FIGS. 27-29 show an alternative embodiment of the knife of FIG. 14 having an alternative safety mechanism.
Figure 28:
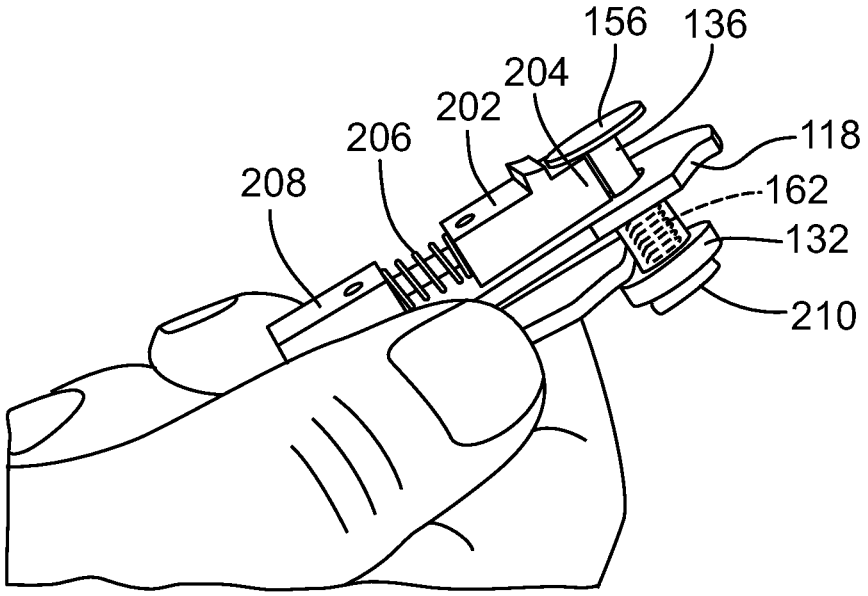
Figure 29:
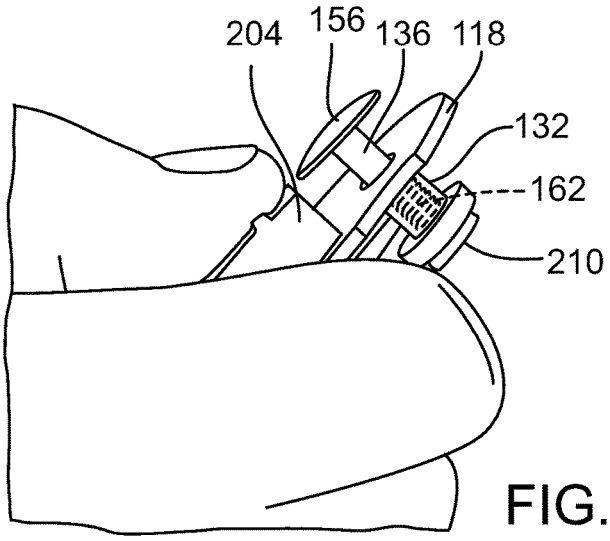

FIGS. 27-29 show an alternative embodiment of a safety mechanism 200 for the knife 100. The blade 104 and the locking mechanism 142 are removed for purposes of illustration. The safety mechanism 200 in the illustrated embodiment comprises a sliding member 202 that can be mounted to a liner 118 of the handle. The sliding member 202 is slidable relative to the handle and the push button 156 between a safety position (FIG. 28) and a release position (FIG. 29). In the safety position, an end portion 204 of the sliding member 202 is positioned behind the push button 156 to block lateral movement of the push button 156 and prevent unlocking of the blade. In the release position, the end portion 204 of the sliding member 202 is spaced from the push button 156 and does not block lateral movement of the push button, thereby allowing movement of the push button and the locking mechanism 142.

The safety mechanism 200 can include a biasing member, such as a coil spring 206 that biases the sliding member 202 to the safety position. The spring 206 can be disposed around a shaft and can have one end that bears against the sliding member 202 and another end that bears against a stationary member 208, which can be a portion of the liner 118 or side panel 116 or a separate component mounted inside the handle.

In the embodiment of FIGS. 27-29, the spring 162 that biases the button 156 and the locking mechanism 142 is mounted on the shaft 136 inside of the bore 134 of the pivot pin 132 rather than outside of the pivot pin 132. One end of the spring 162 can bear against an adjacent surface of the liner 118 and another end of the spring can bear against a washer or plate 210 secured to an end of the shaft 136. The spring 162 functions as described above in connection with FIGS. 21-26 to biases the locking mechanism 142 into engagement with the blade 104. Due to the spring 162 being inside the pivot pin, the spring does not interfere with the operation of the sliding member 202, which can slide behind the push button 156 and abut against the rod 136.

In another embodiment, the safety mechanism can be a sliding member mounted on the locking mechanism 142, such as on the rod 136 or the button 156. The sliding member can be moved between a safety position to block movement of the locking mechanism and a release position to allow movement of the locking mechanism. In the release position, the sliding member is positioned so that it can be pushed laterally into a recess in the handle when manual pressure is applied to the push button 156. In the safety position, the sliding member is offset from the recess in the handle and therefore blocks movement of the push button and the locking mechanism. Further details of such a safety mechanism that can be incorporated in the knife 100 is disclosed in U.S. Provisional Application No. 62/073,851, filed Oct. 31, 2014, which is incorporated herein by reference.

Figure 30:
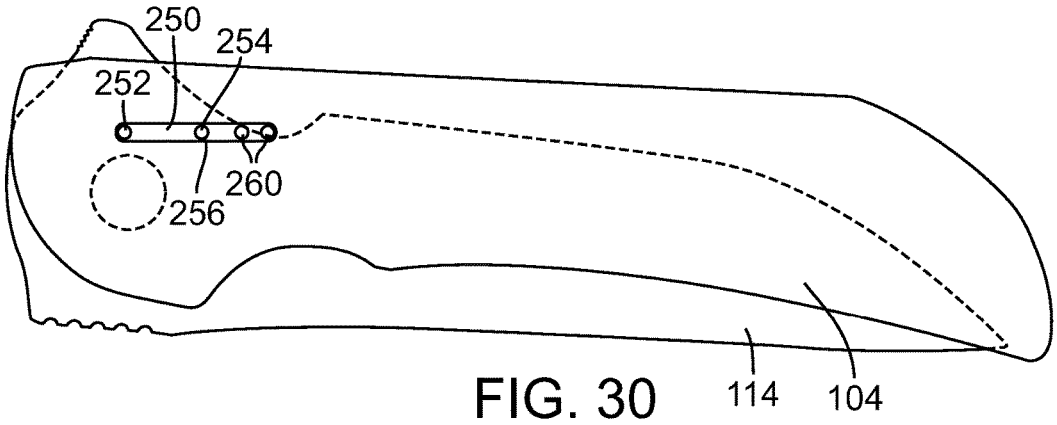
FIGS. 30-31 show an alternative embodiment of the knife of FIG. 14 having a leaf spring configured to help retain the blade in the closed position.
Figure 31:
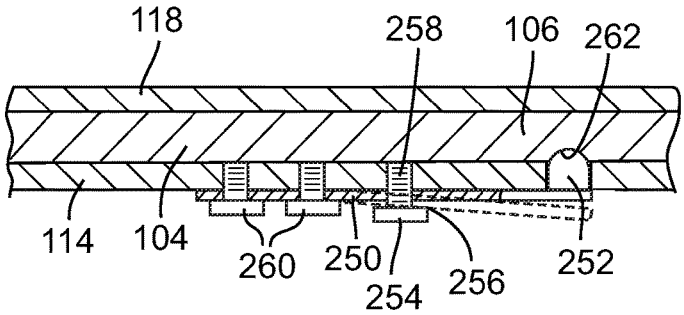

FIGS. 30-31 shows a modification of the knife 100. In this embodiment, the knife 100 can include an internal leaf spring 250 that exerts a lateral force against the tang 106 of the blade 104 to help retain the blade in the closed position against the weight of the blade. The spring 250 can be secured to the side of the liner 114 with screws 260 that are tightened into the liner 114. Alternatively, the spring 250 can be integrally formed as part of the liner 114 (i.e., the spring 250 is formed by machining or cutting the shape of the spring in the liner 114). The spring 250 has a free end that can have a laterally extending protrusion or ball 252 that can be received by a small recess or opening 262 formed in the tang 106. The bias of the leaf spring 250 forces the ball 252 into the recess 262 and helps retain the blade in the closed position.

The handle 102 can further include an adjustment mechanism to adjust the amount of force the leaf spring 250 exerts against the tang 106. The adjustment mechanism can be, for example, a screw 254 comprising a head portion 256 and a threaded shaft 258 that extends through the leaf spring and is tightened into the liner 114. The head portion 256 is adjacent the side of the leaf spring 250. Thus, tightening the screw 254 causes the head portion 256 to bear against the side of the leaf spring, thereby increasing the force of the spring against the tang 106. Loosening the screw 254 causes the head portion 256 to back away from the leaf spring 250, thereby decreasing the force of the spring against the tang 106. Thus, a user can increase or decrease the force of the spring 250 as desired to adjust the amount of force needed to overcome the spring 250 and pivot the blade 104 away from the closed position.

In alternative embodiments, the knife can be configured to have cam surfaces that are effective to push the locking members out of the locking recesses when manual pressure is applied to the blade to pivot the blade from the open position to the closed position.

In alternative embodiments, the locking recesses can be configured such that the locking members engage or extend into the locking recesses only when the blade is in the open position and therefore do not engage or extend into the locking recesses when the blade is in the closed position. Alternatively, the locking recesses can be configured such that the locking members engage or extend into the locking recesses only when the blade is in the closed position and therefore do not engage or extend into the locking recesses when the blade is in the open position, in which case an alternative locking mechanism (such as a liner lock) may be implemented in the knife to retain the blade in the open position.

In alternative embodiments, the locking mechanism 142 can be formed with only one locking member (e.g., only locking member 148) and/or only one locking recess (e.g., locking recess 166).

In alternative embodiments, the locking members 148, 150 and the locking recesses 166, 168 can be spaced greater than or less than 180 degrees from each other. In some embodiments, the locking mechanism can include more than two locking members and/or more than two locking recesses if it is desired to be able to lock the blade at multiple open positions relative to the handle. For example, the blade may be locked at a fully open position 180 degrees relative to the handle and at one or more partially open positions less than 180 degrees relative to the handle.

In alternative embodiments, the locking mechanism 22 or the locking mechanism 142 can be incorporated in the handle such that the rod 40 or 136 is offset from the pivot pin and the pivot axis of the blade. In such embodiments, the tang of the blade can be formed with an arcuate slot that partially circumscribes the pivot axis and receives the rod, thereby allowing the blade to pivot relative to the rod.

In some embodiments, the knife can have a thumb stud attached to the blade that can be used to open the blade and which acts a stop pin for the blade, as known in the art.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A folding knife, comprising:

a handle comprising first and second opposing handle portions;

a blade having a tang portion pivotally connected to the handle between the first and second handle portions, the blade being operable to pivot relative to the handle about a pivot axis extending through the tang portion, between an open position and a closed position;

a leaf spring which exerts a laterally directed force against the tang portion of the blade when the blade is in the closed position to resist opening of the blade in response to a force less than a predetermined threshold, the leaf spring comprising a laterally extending protrusion that contacts the tang portion of the blade at a location spaced from a rear edge of the tang portion when the blade is in the open position and the closed position, and the protrusion extending into a recess formed in a side surface of the tang portion when the blade is in the closed position;

an adjustment element operable by a user to adjust the amount of laterally directed force the leaf spring exerts against the tang portion;

a locking mechanism, separate from the leaf spring, configured to engage a locking feature on the tang portion of the blade when the blade is in the open position to resist pivoting of the blade to the closed position; and wherein the force of the leaf spring against the blade in the closed position retains the blade in the closed position against the weight of the blade yet allows the blade to move from the closed position to the open position when a manual force is applied to the blade.

2. The folding knife of claim 1, wherein the adjustment element comprises a screw having an end positioned to engage the leaf spring, wherein the screw is configured such that adjusting the screw laterally toward and away from a side surface of the leaf spring is effective to vary the amount of force exerted on the tang portion by the leaf spring.

3. The folding knife of claim 1, wherein the tang portion has first and second opposing side surfaces facing the first and second opposing handle portions, respectively, and a rear edge extending laterally from the first side surface to the second side surface, wherein the leaf spring contacts the first side surface of the tang portion at a location spaced from the rear edge when the blade is in the open position and the closed position.

4. The folding knife of claim 1, wherein the protrusion comprises a ball.

5. The folding knife of claim 1, further comprising a screw that extends through the leaf spring and is tightened into the first handle portion to secure the leaf spring relative to the first handle portion.

6. The folding knife of claim 5, wherein the first handle portion comprises an outer side panel and an inner liner, and wherein the leaf spring is secured to the inner liner by the screw.

7. The folding knife of claim 1, wherein the handle comprises an inner liner and wherein the leaf spring is integrally formed as part of the liner.

8. A folding knife, comprising:

a handle comprising first and second opposing handle portions;

a blade having a tang portion pivotally connected to the handle between the first and second handle portions, the blade being operable to pivot relative to the handle about a pivot axis extending through the tang portion, between an open position and a closed position;

a leaf spring which exerts a laterally directed force against the tang portion of the blade when the blade is in the closed position to resist opening of the blade in response to a force less than a predetermined threshold;

an adjustment element operable by a user to adjust the amount of laterally directed force the leaf spring exerts against the tang portion;

a screw that extends through the leaf spring and is tightened into the first handle portion to secure the leaf spring relative to the first handle portion;

wherein the first handle portion comprises an outer side panel and an inner liner, and wherein the leaf spring is secured to the inner liner by the screw; and wherein the leaf spring and the blade are positioned on opposite sides of the inner liner, and the leaf spring comprises a laterally extending protrusion that extends through an opening in the liner and contacts the tang portion of the blade.

9. A folding knife, comprising:

a handle comprising first and second opposing handle portions;

a blade having a tang portion pivotally connected to the handle between the first and second handle portions, the blade being operable to pivot relative to the handle about a pivot axis extending through the tang portion, between an open position and a closed position, the tang portion having first and second side surfaces facing the first and second opposing handle portions, respectively, and a rear edge extending laterally from the first side surface to the second side surface;

a leaf spring having a free end portion configured to engage the first side surface of the tang portion at a location spaced from the rear edge when the blade is in the closed position and the open position, wherein when the blade is in the closed position, the free end portion exerts a laterally directed force against the first side surface of the tang portion to resist opening of the blade in response to a force less than a predetermined threshold; and a locking mechanism, separate from the leaf spring, configured to engage a locking feature on the tang portion of the blade when the blade is in the open position to resist pivoting of the blade to the closed position.

10. The folding knife of claim 9, further comprising an adjustment element operable by a user to adjust the amount of force the leaf spring exerts against the first side surface of the tang portion.

11. The folding knife of claim 10, wherein the adjustment element comprises a screw comprising an end portion and a threaded shaft engaging a threaded opening in the first handle portion, the end portion of the screw engaging the leaf spring, wherein adjusting the position of the threaded shaft within the threaded opening is effective to adjust the amount of force exerted against the tang portion by the leaf spring.

12. The folding knife of claim 11, further comprising a screw that extends through the leaf spring and is tightened into the first handle portion to secure the leaf spring relative to the first handle portion.

13. The folding knife of claim 9, wherein the free end portion of the leaf spring comprises a laterally extending protrusion that engages the first side surface of the tang portion when the blade is in the closed position and the open position.

14. The folding knife of claim 13, wherein the first side surface of the tang portion comprises a recess that receives the laterally extending protrusion when the blade is in the closed position.

15. A folding knife, comprising:

a handle comprising first and second opposing handle portions;

a blade having a tang portion pivotally connected to the handle between the first and second handle portions, the blade being operable to pivot relative to the handle about a pivot axis extending through the tang portion, between an open position and a closed position, the tang portion having first and second side surfaces facing the first and second opposing handle portions, respectively and a rear edge extending laterally from the first side surface to the second side surface;

a leaf spring having a free end portion configured to engage the first side surface of the tang portion at a location spaced from the rear edge when the blade is in the closed position and the open position, wherein when the blade is in the closed position, the free end portion exerts a laterally directed force against the first side surface of the tang portion to resist opening of the blade in response to a force less than a predetermined threshold;

an adjustment element operable by a user to adjust the amount of lateral force the leaf spring exerts against the tang portion;

wherein the adjustment element comprises a screw comprising an end portion and a threaded shaft engaging a threaded opening in the first handle portion, the end portion of the screw engaging the leaf spring, wherein adjusting the position of the threaded shaft within the threaded opening is effective to adjust the amount of force exerted against the tang portion by the leaf spring;

a screw that extends through the leaf spring and is tightened into the first handle portion to secure the leaf spring relative to the first handle portion; and a locking mechanism, separate from the leaf spring, configured to engage a locking feature on the tang portion of the blade when the blade is in the open position to resist pivoting of the blade to the closed position.

16. A folding knife, comprising:

a handle comprising first and second opposing handle portions;

a blade having a tang portion pivotally connected to the handle between the first and second handle portions, the blade being operable to pivot relative to the handle about a pivot axis extending through the tang portion, between an open position and a closed position;

a leaf spring comprising a laterally extending protrusion that contacts the tang portion of the blade at a location spaced from a rear edge of the tang portion when the blade is in the open position and the closed position, and the protrusion extending into a recess formed in a side surface of the tang portion when the blade is in the closed position so as to resist opening of the blade in response to a force less than a predetermined threshold;

wherein the engagement of the protrusion with the recess retains the blade in the closed position against the weight of the blade yet allows the blade to move from the closed position to the open position when a manual force is applied to the blade; and a locking mechanism, separate from the leaf spring, configured to engage a locking feature on the tang portion of the blade when the blade is in the open position to resist pivoting of the blade to the closed position.

17. The folding knife of claim 16, further comprising an adjustment element operable by a user to adjust an amount of a laterally directed force the leaf spring exerts against the tang portion.

* * * * *